United States Patent [19]

Kaisner

[11] 4,318,159

[45] Mar. 2, 1982

[54] MAGNETIC LIGHT FIXTURE

[76] Inventor: Melvin C. Kaisner, 19309 U.S. 41 North, Lutz, Fla. 33549

[21] Appl. No.: 119,093

[22] Filed: Feb. 6, 1980

[51] Int. Cl.[3] ..... F21P 1/02

[52] U.S. Cl. ..... 362/124; 362/251; 362/252; 362/414; 362/808

[58] Field of Search ..... 362/124, 251, 808, 252, 362/414

[56] References Cited

U.S. PATENT DOCUMENTS 2,558,600 6/1951 Wilson ..... 362/124

3,531,634 9/1970 Plouch ..... 362/124

*Primary Examiner*—Stephen J. Lechert, Jr.

*Attorney, Agent, or Firm*—Frijouf, Rust & Pyle

[57] ABSTRACT

A lamp fixture comprising a first figurine mounted to a base and a second figurine connected relative to the base by means of a flexible member. A first lamp socket and a lamp shade are disposed at the top of a lamp pole. A second lamp socket is disposed within the interior of the first figurine. Movement of the second figurine to a first and a second position actuates an electrical circuit which supplies household current via a power cord to the first and the second lamp sockets, respectively, to light lamp bulbs contained therein. The electrical circuit comprises reed switches which are actuated by a magnet disposed within the second figurine. Each reed switch triggers a thyristor such as a triac or two silicon controlled rectifiers connected in parallel to provide a path for the household current to flow to the respective lamp socket. Movement of the second figurine to a neutral position precludes the household current from flowing to either the first or second lamp socket. The foregoing abstract is merely a resume of one general application, is not a complete discussion of all principles or operation or applications, and is not to be construed as a limitation on the scope of the claimed subject matter.

7 Claims, 8 Drawing Figures

MAGNETIC LIGHT FIXTURE

BACKGROUND OF THE INVENTION

1. Field of the Invention

This invention relates to lamp fixtures. More particularly, this invention relates to lamp fixtures which operate as a conventional lamp fixture and, alternatively, as a conventional night light.

2. Description of the Prior Art

Presently there exists many types of lamp fixtures having a variety of shapes and functions. One function of a conventional lamp fixture is to supply electrical current to a lamp socket to light a lamp bulb contained therein. The light emitted from the lamp bulb shines through a lamp shade or the like to light the surrounding area. Another function is to supply electrical current to a lamp socket to light a relatively low intensity light bulb. The soft light emitted therefrom acts as a night light. The use of a night light is particularly attractive to children who may be afraid of the dark.

Both functions of conventional lamp fixtures require the use of mechanical switches to turn the lamp bulb on or off. Mechanical switches have become undesirable since they preclude any uniqueness in the design of the lamp fixture. Consumer preferences are, therefore, limited to the existing lamp fixtures which incorporate mechanical switches.

Therefore it is an object of this invention to provide an apparatus which overcomes the aforementioned inadequacies of the prior art devices and provides an improvement which is a significant improvement to the advancement of the lamp fixture art.

Another object of this invention is to provide a lamp fixture which operates as a conventional lamp fixture and obviates the need of mechanical switches.

Another object of this invention is to provide a lamp fixture which comprises a first and a second figurine and which operates as a conventional lamp fixture when the second figurine is moved to a first position on the base of the lamp fixture.

Another object of this invention is to provide a lamp fixture which comprises a first and a second figurine and which operates as a conventional night light when the second figurine is moved to a second position on the base of the lamp fixture.

Another object of this invention is to provide a lamp fixture which comprises a first and a second figurine having shapes which reminds one of a nursery rhyme, fairy tale or fantasy world.

Another object of this invention is to provide a lamp fixture which comprises an electrical circuit actuated by the second figurine.

Another object of this invention is to provide a lamp fixture which comprises an electrical circuit having a reed switch which triggers a switch means to supply electrical current to the lamp socket to light a lamp bulb contained therein.

Another object of this invention is to provide a lamp fixture which comprises an electrical circuit having a thyristor as the switch means.

Another object of this invention is to provide a lamp fixture which comprises an electrical circuit having a triac as the switch means.

Another object of this invention is to provide a lamp fixture which comprises an electrical circuit having two silicon controlled rectifiers connected in parallel as the switch means.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention is a lamp fixture comprising a first figurine mounted to a base and a second figurine movable to different positions on the base. A lamp pole is secured to the base. A first lamp socket and a lamp shade are secured to the top of the lamp pole. A second lamp socket is disposed within the interior of the first figurine. A novel electrical circuit enables conventional household current to flow via a power cord to the first and the second lamp socket upon movement of the second figurine into a first and a second position, respectively. More specifically, movement of the second figurine into the first position causes current to flow to the first lamp socket to light a lamp bulb contained therein. The lamp fixture then operates as a conventional lamp fixture with light emitted from the lamp bulb shining through the lamp shade. Alternatively, movement of the second figurine to the second position causes current to flow to the second lamp socket to light a lamp contained therein. The lamp fixture then operates as a conventional night light with light emitted from the lamp bulb shining through the aperatures in the first figurine.

The first and second figurine may have any shape. Preferrably, however, the first and second figurine have shapes which reminds one of a nursery rhyme, fairy tale or fantasy world.

The electrical circuit is actuated when the second figurine is moved into either the first or second position on the base of the lamp fixture. Actuation is caused by subjecting a first and a second magnetic reed switch to the magnetic field created by a magnet disposed in a cavity in the second figurine. When the contacts of the first or the second reed switch close, the reed switches trigger a switch means which supplies electrical current to the first or the second lamp socket, respectively.

The switch means of the electrical circuit comprises thyristors whose gates are triggerable by the first and second reed switches. In the first embodiment, each thyristor comprises a triac, and in the second embodiment, each thyristor comprises two silicon controlled rectifiers connected in parallel.

When the second figurine is moved to a neutral position away from the first and the second position on the base, neither the first nor the second reed switches is subjected to the magnetic field, and no electrical current flows to either the first or the second lamp socket.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purpose of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DESCRIPTION OF THE PREFERRED EMBODIMENT

Figure 1:
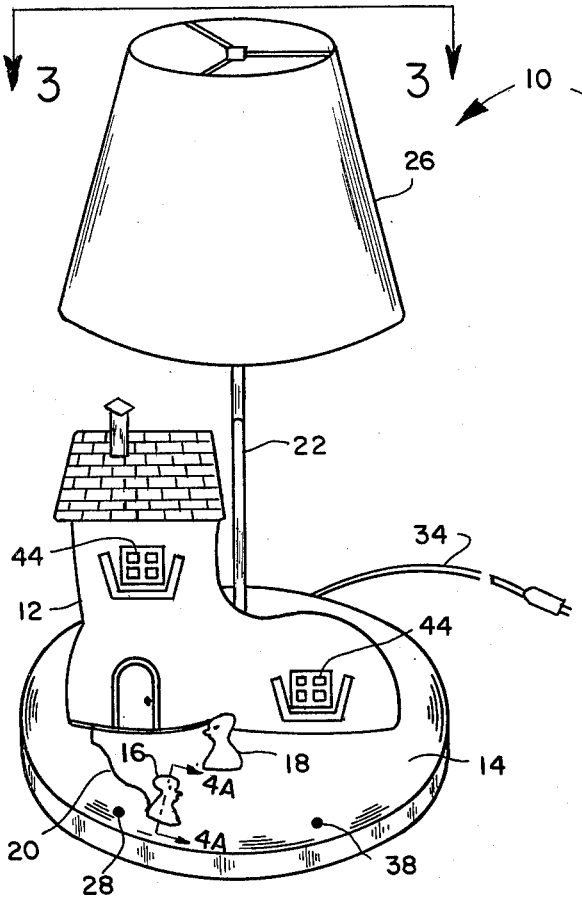
FIG. 1 is a perspective view of a first embodiment of the lamp fixture showing a first and a second figurine disposed on a base.

FIG. 1 is a perspective view of the first embodiment of the lamp fixture 10 showing a figurine 12 mounted to a base 14. Figurine 12 has the shape of a shoe which reminds one of the nursery rhyme, "The Old Lady Who Lived In The Shoe". A second figurine 16 and a third figurine 18 reminds one of the nursery rhyme, "Little Bo Peep". More specifically, the third figurine 18 has the shape of Bo Peep and the second figurine 16 has the shape of a sheep. The third figurine 18 is mounted on the base 14 and the second figurine 16 is connected relative to the base 14 by means of a flexible member 20. The flexible member 20 may comprise a string which is connected to the second figurine 16 and the base 14. A lamp pole 22 is connected to the base 14 and supports a lamp socket 24 and a lamp shade 26 which are disposed above the base 14.

When moved to a first position 28, the second figurine 16 actuates an electrical circuit 30 (described hereinafter) which supplies power from a power source through a power cord 34 to the lamp socket 24 to light a lamp bulb 36 contained therein. Alternatively, when moved to a second position 38, the second figurine 16 actuates the electrical circuit 30 which supplies power to a second lamp socket 40 disposed in the first figurine 12 to light a second lamp bulb 42 contained therein. It is therefore evident that with the second figurine 16 in the first position 28, the lamp fixture 10 operates as a conventional lamp fixture with light emitted from the lamp bulb 36 shining through the lamp shade 26. With the second figurine 16 in the second position 38, the lamp fixture 10 operates as a night light with the light emitted from the lamp bulb 42 shining through the apertures 44 which comprise the windows of the shoe of the first figurine 12.

Figure 2:
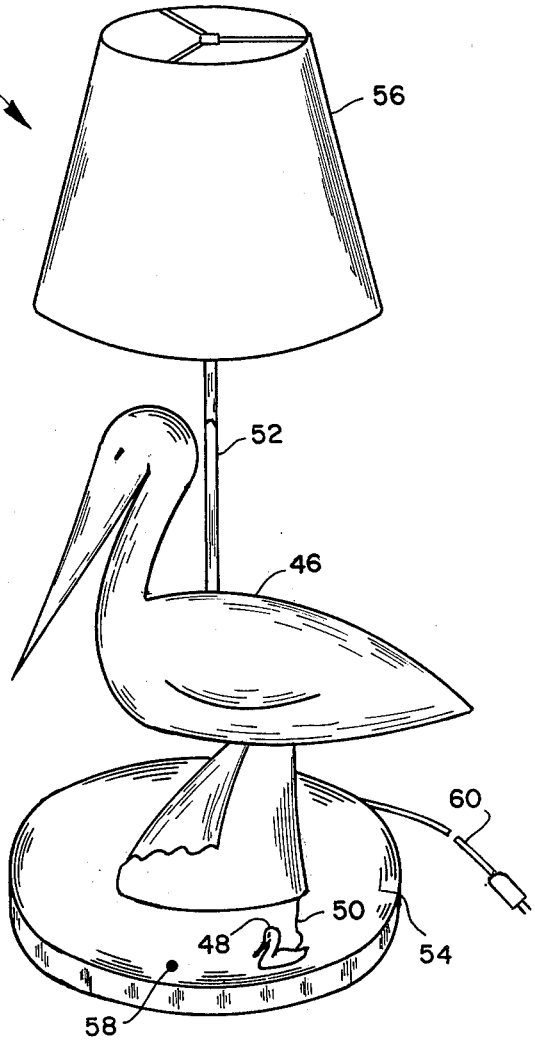
FIG. 2 is a perspective view of a second embodiment of the lamp fixture showing a first and a second figurine disposed on the base.

FIG. 2 is the second embodiment of the lamp fixture 10 including a first figurine 46 having the shape of a pelican. The second figurine 48, which is connected to the first figurine by means of a flexible member 50, has the shape of a baby duckling. The first figurine 46 and the lamp pole 52 are connected to the base 54. A lamp socket (not shown) and a lamp shade 56 are connected to the lamp pole 52. Movement of the second figurine 48 into a first position 58 actuates the electrical circuit 30 of the lamp fixture 10 which causes power coming from the power cord 60 to be supplied to the lamp socket to light a lamp bulb (not shown) contained therein.

It should be noted that the particular shape of the first figurine 12 and 46 in the first or second embodiment of the lamp fixture 10 may be of different shapes having ecstatic value. Accordingly, this invention is not limited to first or second figurines having the particular shape as shown in the drawings.

Figure 3:
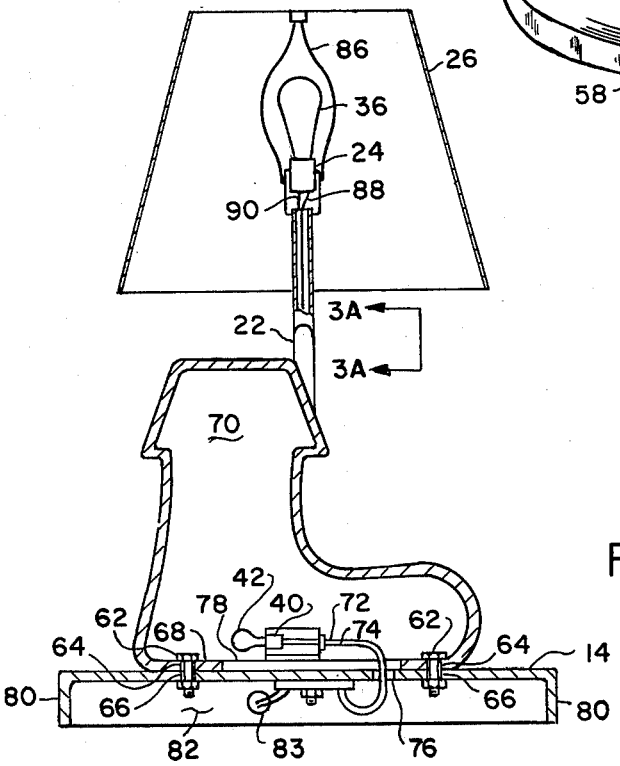
FIG. 3 is a cross-sectional view of FIG. 1 along lines 3—3 showing the lamp bulb disposed within the lamp shade and the night light bulb disposed within the first figurine.

FIG. 3 is a cross-sectional view of the first embodiment of the lamp fixture 10 shown in FIG. 1. The first figurine 12 is connected to the base 14 by means of threaded fasteners 62 such as bolts. The threaded fasteners 62 extend through holes 64 and 66 in the bottom 68 of the first figurine 12 and the base 14, respectively. Alternatively, the first figurine 12 may be connected to the base 14 by means of a glue such as epoxy resin.

Disposed inside the interior 70 of the first figurine 12 is the lamp socket 40 which receives the lamp bulb 42. The lamp socket 40 is a standard socket conventional in the art. Connectors 72 and 74 lead from the electrical circuit 30 through an aperture 76 in the base 14 and another aperture 78 in the bottom 68 of the first figurine 12 to the lamp socket 40. The connectors 72 and 74 provide a path for the electrical power from the electrical circuit 30 to flow to the lamp socket 40 to light the lamp bulb 42. As noted earlier, the lamp bulb 42 contained within the interior 70 of the first figurine 12 acts as a night light emitting light through the apertures 44 in the wall of the first figurine 12.

The base 14 of the lamp fixture 10 inclues an annular skirt 80 which defines the volume of the interior 82 of the base 14. The interior 82 has sufficient volume to enclose the electrical circuit 30 and the heads of the threaded fasteners 62. The power cord 34 enters through an aperture 83 in the skirt 80 and connects the electrical circuit 30.

Figure 4:
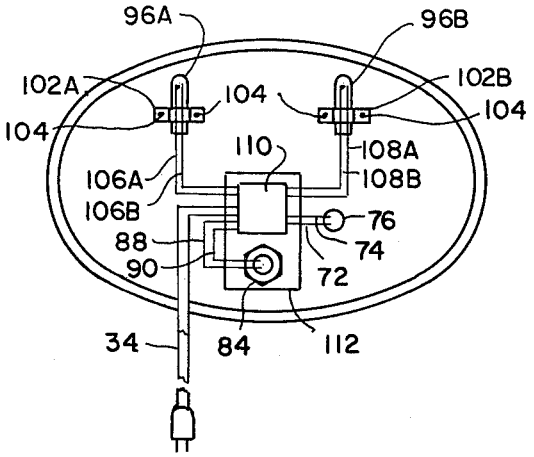
FIG. 4 is an internal view of FIG. 1 showing the reed switches, the switch means and the interconnections therebetween.

Referring to FIG. 4 in conjunction with FIG. 3, the lamp pole 22 is disposed through the base 14 and is connected thereto by means of a threaded nut 84. Disposed at the upper end of the lamp pole 22 is the lamp socket 24 which receives the lamp bulb 25. A cage member 86 is secured to the lamp socket 24 and encompasses the lamp bulb 25. The cage member 86 supports the lamp shade 26 which is disposed over the lamp fixture 10. Connectors 88 and 90 lead from the electrical circuit 30 through the inside of the lamp pole 22 to the lamp socket 24. Connectors 88 and 90 supply power from the electrical circuit 30 to the lamp socket 24 to light the lamp bulb 25 contained therein.

Figure 3A:
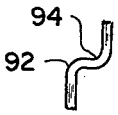
FIG. 3A is a partial cross-sectional view of FIG. 3 along lines 3A—3A showing the bends in the lamp pole.

As shown in FIG. 3A, the lamp pole 22 has two right angle bends 92 and 94 which causes the lamp socket 24, and correspondingly the lamp shade 26, to be centered over the base 14 of the lamp fixture 10.

Figure 4A:
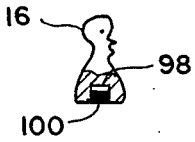
FIG. 4A is a cross-sectional view of FIG. 1 along lines 4A—4A showing the interior of the second figurine.

FIG. 4 is a bottom view of the first embodiment of the lamp fixture 10 showing a block diagram of the electrical circuit 30. Trigger means 96 are actuated by the second figurine 16. More particularly, trigger means 96 comprises magnetic reed switches 96A and 94B which are actuated when subjected to a magnetic field. FIG. 4A is a cross-sectional view of the second figurine 16 showing the interior cavity 98 thereof. A magnet 100 is disposed in the cavity 98 by means of a glue such as an epoxy resin. When the second figurine 18 is moved to the first position 28, the magnetic field created by the magnet 100 actuates the reed switch 96A. Similarly, when the second figurine 16 is moved to the second position 38, the magnet 100 actuates the reed switch 96B. It should be appreciated that the base 14 must be made from a non-ferric material such that the magnetic field created by magnets 100 can transmit through the base 14 to actuate the reed switches 96. Accordingly, the base 14 is preferably made from a ceramic material.

Reed switches 96A and 96B are secured to the underside of the base 14 by means of brackets 102A and 102B which are fastened to the base 14 by means of a glue or threaded fasteners 104. Connectors 106A and 106B and connectors 108A and 108B lead from the contacts of the reed switches 96A and 96B, respectively, to the switch means 110. Upon being triggered by the trigger means 96, the switch means 110 supplies power from the power cord 34 to the lamp sockets 24 or 40 by means of connectors 88, 90, 72 and 74. The switch means 110 is secured to the underside of the base 14 by means of a plate 112 which is connected to the lamp pole 22 by the threaded nut 84.

It should be appreciated that capacitively sensitive switches (not shown) may be substituted for the magnetic reed switches 96A and 96B. The capacitively sensitive switches would be actuationable by moving the second figurine 16 in close proximity thereto, and thus would operate in the same manner as reed switches 96A and 96B.

Figure 5:
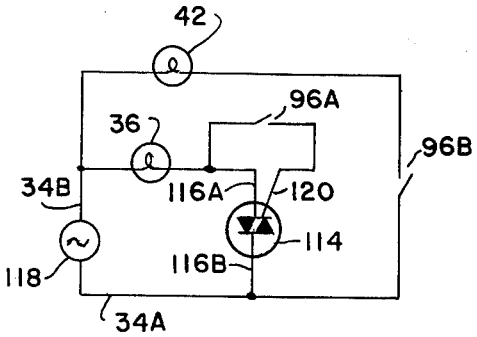
FIG. 5 is a first schematic diagram of an electrical circuit of the lamp fixture having a triac as the switch means.
Figure 6:
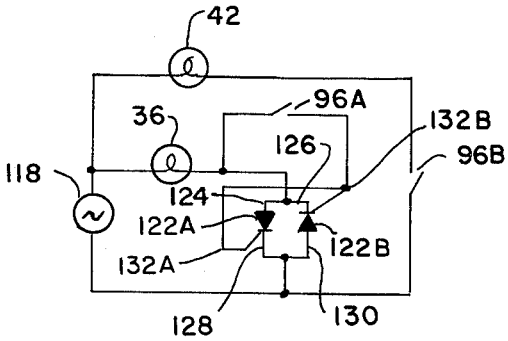
FIG. 6 is a second schematic diagram of an electrical circuit of the lamp fixture having two silicon controlled rectifiers connected in parallel as the switch means.

FIG. 5 and FIG. 6 are schematic diagrams of the first and second embodiment of the electrical circuit 30, respectively. Referring to FIG. 5, the first embodiment of the electrical circuit 30 includes the switch means 110 as comprising a triac 114 whose first main terminal 116A is connected to lamp bulb 36. The second main terminal 116B of triac 114 is connected to one conductor 34A of the power cord 34 shown schematically as power source 118. The other conductor 34B of the power cord 34 is connected to lamp bulb 36. The reed switch 96A is connected between the lamp bulb 36 and the gate 120 of the triac 114. When the reed switch 96A is actuated by being subjected to the magnetic field created by magnet 100, the contacts of reed switch 96A close and thus supplies voltage from the power source 118 to the gate 120 to trigger the triac 114 into a conducting state. When the triac 114 is in a conducting state, the power source 118 supplies power to the lamp bulb 36. The conductors 34A and 34B of the power cord 34, the lamp bulb 42 and the reed switch 96B are connected serially to one another. Upon actuation reed switch 96B by magnet 100, power from the power source 118 flows to the lamp bulb 42. Because of the relatively lower power requirements of lamp bulb 42 when used as a night light, the contacts of reed switch 96B are able to accommodate the current flowing to the lamp bulb 42. Thus, reed switch 96B is directly connected between the lamp bulb 42 and the power source 118 rather than being used to trigger a triac.

FIG. 6 is a schematic diagram of the second embodiment of the electrical circuit 30 wherein silicon controlled rectifiers (SCR) 122A and 122B, are connected in parallel. More particularly, the anode 124 of the first SCR 122A and the cathode 126 of the second SCR 122B are connected to the lamp bulb 36. Likewise, the cathode 128 of the first SCR 122A and the anode 130 of the second SCR 122B are connected to the power source 118. The gates 132A and 132B of the first and second SCRs 122A and 122B, respectively, are connected to the reed switch 96A. When reed switch 96A is subjected to the magnetic field created by magnet 100, the reed switch 96A triggers gates 132A and 132B which causes the SCRs 122A and 122B to be in a conducting state. In a conducting state, the SCRs 122A and 122B provide a path from the power source 118 to flow to the lamp bulb 36. The connection of the second reed switch 96B to the power source 118 and to the lamp bulb 42 is identical to the first embodiment described previously.

It is noted that the triac 114 and the SCRs 122A and 1aaB are species of the generic family of thyristors. Accordingly, a large variety of thyristors may be substituted for either the triac 114 or the parallel combination of SCRs 122A and 122B without departing from the scope of this invention.

It is further noted that the electrical circuit 30 may comprise a single reed switch 96 to trigger the switch means 110 thereby providing power to a single lamp bulb. For instance, in the second embodiment of the lamp fixture as shown in FIG. 2, movement of second figurine 48 to the first position 58 subjects the reed switch 96 to a magnetic field. The reed switch 96 then triggers the switch means 110 which provides power from the power cord 60 to the lamp socket to light the lamp bulb.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

I claim:

1. A lamp fixture for supplying electrical power from a power source to a lamp bulb, comprising in combination:

a base;

a figurine mounted to said base;

a light pole mounted relative to said base;

a lamp socket mounted to said light pole;

a switch means;

means for connecting said switch means to said lamp socket;

a trigger means for triggering said switch means;

means for connecting said trigger means to said switch means enabling the switch means to supply power from the power source to said lamp socket while said switch means is being triggered by said trigger means;

a second figurine for actuating said trigger means;

said second figurine being disassociated from said trigger means such that said second figurine is not mechanically connected to said trigger means; and said second figurine being movable in close proximity to said trigger means enabling said second figurine to actuate said trigger means while said second figurine is in a close proximity to said trigger means.

2. The lamp fixture as set forth in claim 1, further comprising in combination:

a cavity disposed in said second figurine;

a magnet disposed in said cavity; and said trigger means comprising a magnetically sensitive switch having electrical contacts which close when subjected to a magnetic field.

3. The lamp fixture as set forth in claim 2, wherein said magnetically sensitive switch comprises a reed switch.

4. The lamp fixture as set forth in claim 1, including a flexible member which connects said second figurine relative to the lamp fixture.

5. The lamp fixture as set forth in claim 1, wherein said switch means comprises a thyristor which is triggerable by said trigger means.

6. The lamp fixture as set forth in claim 5, wherein said thyristor comprises a triac;

means for connecting the first main terminal of said triac to said lamp socket;

means for connecting the second main terminal of said triac to the power source; and means for connecting said trigger means to the gate of said triac for triggering said triac into a conducting state thereby supplying power from the power source to said lamp socket.

7. The lamp fixture as set forth in claim 5, wherein said thyristor comprises a first and a second silicon controlled rectifier;

means for connecting the anode of said first silicon controlled rectifier and the cathode of said second controlled rectifier to said lamp socket;

means for connecting the cathode of said first silicon controlled rectifier and the anode of said second silicon controlled rectifier to the power source; and means for connecting said trigger means to the gates of said first and second silicon controlled rectifiers enabling said trigger means to trigger said first and second silicon controlled rectifiers into a conducting state thereby supplying power from the power source to said lamp socket.

* * * * *